US005864906A

United States Patent [19]

Pacelli

[11] Patent Number: 5,864,906

[45] Date of Patent: Feb. 2, 1999

[54] CORNER GUARD FOR MATTRESS BOX SPRING

[76] Inventor: Joseph G. Pacelli, 188 Bedford Rd., Greenwich, Conn. 06831

[21] Appl. No.: 985,224

[22] Filed: Dec. 4, 1997

[51] Int. Cl.[6] ..... A47C 23/00; A47C 21/00

[52] U.S. Cl. ..... 5/663; 248/345.1

[58] Field of Search ..... 5/663, 254, 739, 5/279.1, 246; 248/345.1; D6/606

[56] References Cited

U.S. PATENT DOCUMENTS

D. 384,537 10/1997 Quintile ..... D6/606
3,406,411 10/1968 La Reis ..... 5/474
5,628,080 5/1997 Quintile ..... 5/663

FOREIGN PATENT DOCUMENTS 909976 11/1962 United Kingdom ..... 248/345.1

*Primary Examiner*—Alex Grosz
*Attorney, Agent, or Firm*—Alfred E. Miller

[57] ABSTRACT

A corner guard for a mattress box spring having a one piece bottom flange extending perpendicular to a curved upright side wall. The flange has a notch centrally located for permitting flexing of the wall in opposite directions and a reduced thickness center section of the wall which permits further flexing of the side wall. The bottom flange is provided with additional securing area for stapling or nailing to overcome stress fracture of the box spring frame.

8 Claims, 2 Drawing Sheets

CORNER GUARD FOR MATTRESS BOX SPRING

The present invention relates to a corner reinforcement for a rectangular-shaped mattress foundation or a box spring. A mattress or box spring is normally supported on a frame. In such an arrangement, often the soft padded material at the corners of the box spring will abrade and become punctured at the corners. To overcome this condition several reinforcing guards are known from the prior art, such as U.S. Pat. No. 3,406,411 to Reis and U.S. Pat. No. 5,628,080 to Quintile. The Reis patent discloses a self-supporting, uniformly thick corner guard with two inwardly directed narrow securing flanges, while the patent to Quintile also discloses a self-supported uniformly thick corner guard having a series of separate securing spaced tabs. Neither of these patents address the problem of stress cracking as a result of the stapling of the corner guard to the mattress frame nor the problem of providing a corner guard that can be utilized in a number of different mattress foundation products.

SUMMARY OF THE INVENTION

It is well known that the corner configurations of the various box spring manufacturers varies. The present invention overcomes the drawbacks of prior art corner guard construction variations and it is a feature of the present invention to provide a corner guard for a variety of mattress foundation constructions so that the inventions can be altered on site to accommodate a variety of rectangular-shaped mattress foundations.

It is another feature of the present invention to provide flanges for securing the corner guard to the bottom of the mattress foundation which is of one piece construction but having the ability to flex the corner guard in opposite directions in order to provide an adjustability feature for universal use on a variety of mattress foundations.

It is a further feature of the present invention to provide a wall reduction in the center corner section of the upright wall of the corner guard in order to compensate for the variations in mattress foundation construction.

It is yet a further feature of the present invention to provide additional area bottom box spring supporting flanges for the corner guard that almost completely fills an area bounded by the curved upright wall of the guard and an imaginary line drawn from one end of the corner guide to the other end of the corner guard. This additional flange area increases the securing area for the corner guard to the bottom of the box spring for additional fastening. It should be noted that box springs normally have a thin fabric which is stretched over the bottom of the frame and secured thereto at the edge of the frame. The present construction utilizing an increased area also has the advantage of protecting the corners of the fabric from abrasion and puncture due to mattress movement.

It is another feature of the present invention to provide a V groove substantially in the center of the one piece flange in order to provide a flexibility for the corner guard flange to permit both inward and outward movement depending on the mattress foundation dimensional shape.

It is an object of the present invention to provide a slightly flexible corner guard for a mattress box spring which is relatively simple to manufacture and functions to accommodate a wide variety of foundation constructions.

DESCRIPTION OF THE DRAWINGS

In order that the invention may be more clearly understood, it will now be disclosed in greater detail with reference to the accompanying drawings, in which.

DESCRIPTION OF THE PREFERRED EMBODIMENTS

Figure 2:
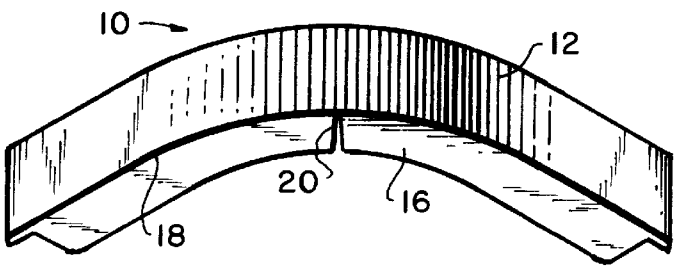
FIG. 2 is a front perspective view thereof.
Figure 4:
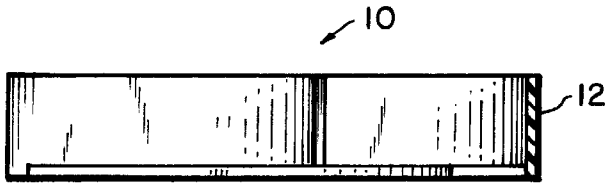
FIG. 4 is a view taken along the lines 4—4 of FIG. 3.
Figure 1:
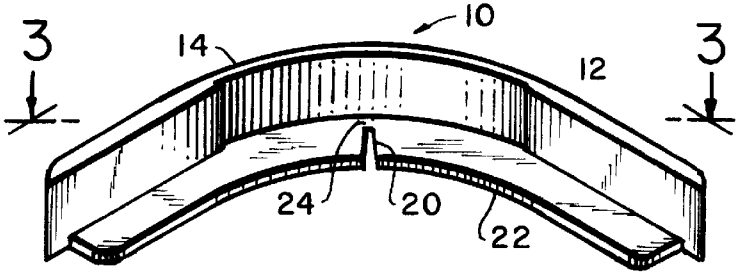
FIG. 1 is a rear perspective view of the box spring corner guard shown in accordance with the teachings of my invention
Figure 3:
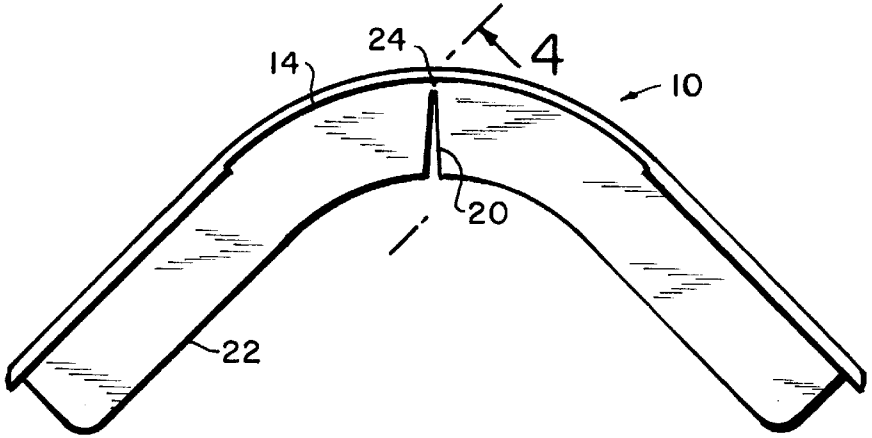
FIG. 3 is a top plan view thereof.
Figure 6:
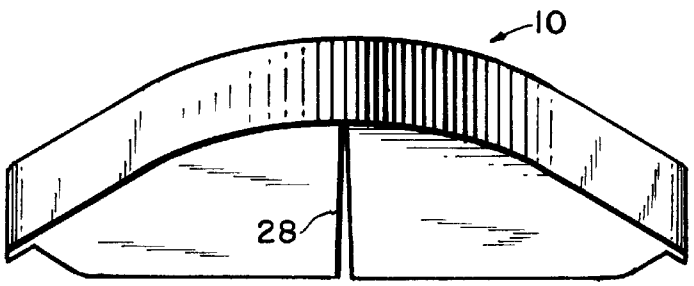
FIG. 6 is a rear perspective view of the embodiment shown in FIG. 5.
Figure 5:
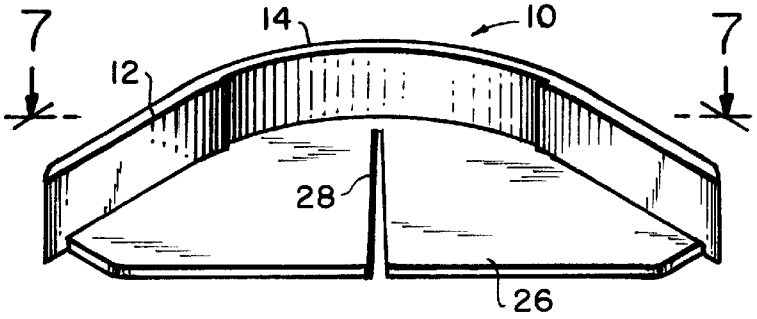
FIG. 5 is a rear perspective view of an alternate modification of my invention shown in FIG. 1
Figure 8:
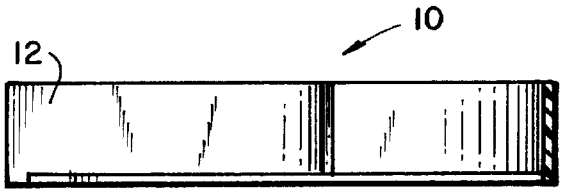
FIG. 8 is a view taken along the lines 8—8 of FIG. 7
Figure 7:
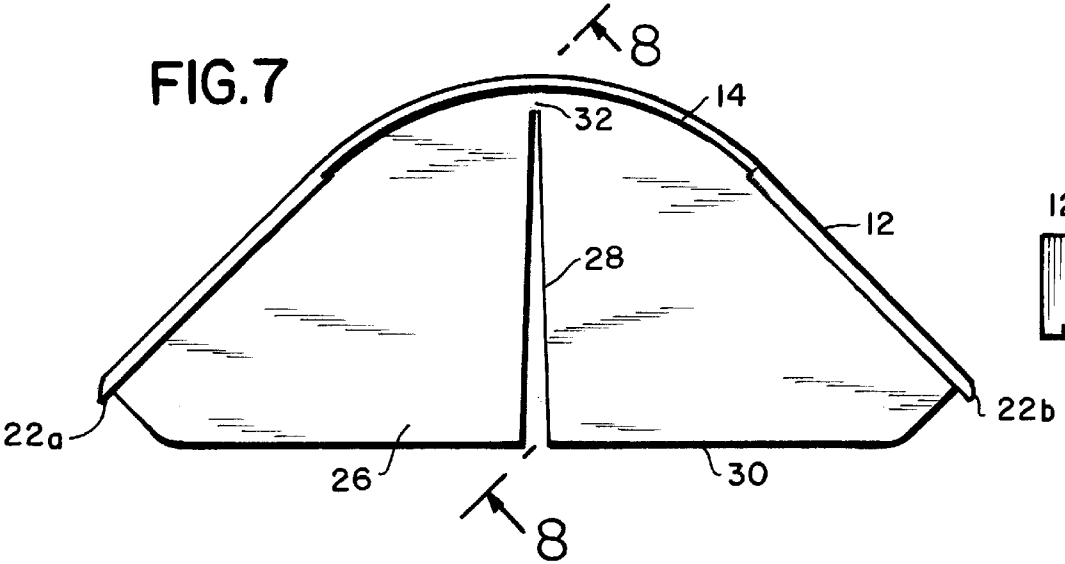
FIG. 7 is a top plan view thereof.

Referring particularly to FIGS. 1–4 in which the present corner guard for a rectangular shaped mattress box spring is shown referred to generally by the reference numeral 10, the corner reinforcement or guard member is provided with a curved upright wall 12, and as seen more particularly in FIGS. 1 and 3, has a reduced, centrally located wall section 14 forming a flexing region. For example, the upright wall may have a thickness, dimension of 0.075" while the reduced wall section would have a thickness of 0.055". As noted above the ability of the corner guard to achieve some flex permits the present invention to compensate for various radial variations in the corners of the box spring.

A single elongated flange 16 extends from the bottom 18 of the wall 12 rearward in a direction substantially perpendicular to the wall 12. Centrally located in the flange 16 is a V-cut notch 20 which extends inwardly from a marginal edge 22. It should be noted that connecting strip 24 is shown between the two sections of the unitary flange 16. The V-cut is preferably 0.375", at the widest part of the "V" and as such, permits the corner guard to be flexed either inwardly or outwardly depending on the shape of the corner of the mattress foundation.

FIGS. 5–8 show an alternate embodiment of the present invention in which like parts bear the same reference numerals. In this construction an enlarged flange 26 is provided with an elongated V-cut notch 28 that extends from the marginal edge 30 toward the wall 12 with a connecting strip 32 connecting the two sections of the flange 26. It should be evident that the two sections of the flange 26 occupy an area bounded by the wall 22 and an imaginary line drawn between the ends 22*a* and 22*b* of said curved side wall 12.

The frame member secured to the bottom of the mattress foundation is normally provided with a thin fabric sheet which is stretched over the frame and covers the bottom of the mattress foundation and is secured thereto for sanitary purposes. The enlarged flange 26 extends over the fabric adjacent to the corner of the mattress foundation thereby protecting the fabric adjacent to the corner from abrasion and puncture due to mattress movement. In addition, the larger flange area also provides an increased securing area for the use of securing means such as by nails or staples, consequently reducing stress cracking in the securement area.

The corner guard illustrated and described has the ability to be flexed both in an inward and outward direction in order to compensate for various variations in corner configurations of mattress foundations or box springs of different manufacturers, as well as providing for better securement to the frame of any mattress foundation.

While there has been shown and described several embodiments of the present invention, it will be understood that various changes in the form and details of the device illustrated and it's operation may be made by those skilled in the art without departing from the spirit of the invention. It is the intention, therefore, to be limited only as indicated by the scope of the claims appended hereto.

What is claimed is:

1. A corner guard for attachment to a rectangular shaped mattress foundation, said mattress foundation being provided with a frame member and comprising: a corner reinforcement member having limited flexibility, adapted to be juxtaposed to a corner of said mattress foundation, having a curved side wall adapted to follow the general configuration of the corner configuration of said mattress foundation, a single continuous flange extending from the bottom of said side wall and being substantially perpendicular to said side wall, and said flange being provided with a notch located generally centrally in said flange to thereby permit the corner guard to be flexed to accommodate variations in the corner configurations of said mattress foundation.

2. A corner guard as claimed in claim 1 wherein said notch is a V-cut.

3. A corner guard as claimed in claim 2 wherein said V-cut extends from a marginal edge of said flange inwardly toward said side wall with the apex of said V-cut spaced from said side wall.

4. A corner guard as claimed in claim 1 wherein said flange is increased in size by occupying a space bounded by the curved side wall and an imaginary line drawn between the ends of said side wall.

5. A corner guard as claimed in claim 1 wherein said corner guard is fabricated of one of the group of polyethylene, polypropylene or acrylovnitrate-butadiene-styrene.

6. A corner guard for attachment to a rectangular shaped upholstered box spring, said box spring provided with a frame member comprising: a corner reinforcement member adapted to be juxtaposed to a corner of said box spring, having a curved side wall adapted to follow the general configuration of the corner of said box spring, said curved side wall having a wall section of reduced thickness centrally in said side wall to thereby permit limited flexibility of said corner guard, a single continuous flange extending from the bottom of said side wall and being substantially perpendicular to said side wall, and said flange being provided with a notch located generally centrally in said flange to thereby additionally permit the corner guard to be flexed to accomodate variations in corner configurations of said box spring.

7. A corner guard as claimed in claim 6 wherein said flange extends from one end of said corner guard to the other end thereof.

8. A corner guard as claimed in claim 6 wherein said reduced wall section is approximately 0.055" in thickness while the remainder of the corner guard has a wall thickness of approximately 0.075".

* * * * *